US007044146B2

(12) United States Patent
Losi, Jr.

(10) Patent No.: US 7,044,146 B2
(45) Date of Patent: May 16, 2006

(54) PORTABLE SHELTER WITH ROLLING ELEMENT BEARINGS

(75) Inventor: Raymond Losi, Jr., Westlake VLG, CA (US)

(73) Assignee: Variflex, Inc., Moorpark, CA (US)

( * ) Notice: Subject to any disclaimer, the term of this patent is extended or adjusted under 35 U.S.C. 154(b) by 67 days.

(21) Appl. No.: 10/783,464

(22) Filed: Feb. 20, 2004

(65) Prior Publication Data

US 2004/0211455 A1 Oct. 28, 2004

Related U.S. Application Data

(60) Provisional application No. 60/482,503, filed on Jun. 24, 2003, provisional application No. 60/449,124, filed on Feb. 21, 2003.

(51) Int. Cl.
*E04H 15/50* (2006.01)

(52) U.S. Cl. ..... 135/145; 135/131; 135/151; 248/277.1; 403/71; 52/109

(58) Field of Classification Search ..... 135/143–145, 135/131, 151, 909; 403/68, 71, 79, 112–116, 403/157; 52/646, 109; 384/548, 618; 248/164, 248/277.1

See application file for complete search history.

(56) References Cited

U.S. PATENT DOCUMENTS

| | | | |
|---|---|---|---|
| 684,130 | A | 10/1901 | Taubert |
| 1,007,322 | A | 10/1911 | Barnes |
| 1,326,006 | A | 12/1919 | Sterhardt |
| 1,449,894 | A | 3/1923 | Dial |
| 1,493,915 | A | 5/1924 | Baker |
| 1,499,395 | A | 7/1924 | Muehleisen et al. |
| 1,502,898 | A | 7/1924 | Berg |
| 1,504,889 | A | 8/1924 | Hansen |
| 1,712,826 | A | 5/1929 | Hvid |
| 1,728,356 | A | 9/1929 | Morgan |
| 2,243,190 | A | 5/1941 | Capaldo |
| 2,284,686 | A | 6/1942 | Rupright |
| 2,454,483 | A | 11/1948 | Rysick |
| 2,752,213 | A | 6/1956 | Swart et al. |
| 2,889,838 | A | 6/1959 | Aviezer et al. |
| 3,126,815 | A | 3/1964 | May et al. |
| 3,174,397 | A | 3/1965 | Sanborn |
| 3,199,518 | A | 8/1965 | Glidewell |
| 3,335,815 | A | 8/1967 | Oakes |
| 3,375,624 | A | 4/1968 | Mikulin |
| 3,496,687 | A | 2/1970 | Greenberg et al. |
| 3,526,066 | A | 9/1970 | Hagar et al. |
| 3,844,663 | A | 10/1974 | Prette |
| 3,909,055 | A | 9/1975 | Koppel |
| 4,025,208 | A | 5/1977 | Donahue |
| 4,026,313 | A | 5/1977 | Zeigler |
| 4,077,418 | A | 3/1978 | Cohen |
| 4,156,433 | A | 5/1979 | Beaulieu |
| 4,243,339 | A | 1/1981 | Dickerson |
| 4,262,460 | A | 4/1981 | Bertin |

(Continued)

FOREIGN PATENT DOCUMENTS

| | | |
|---|---|---|
| DE | 1434526 | 12/1968 |

(Continued)

*Primary Examiner*—Winnie Yip
(74) *Attorney, Agent, or Firm*—Holland & Hart LLP

(57) ABSTRACT

The present invention provides an improved portable shelter frame having upwardly extending support poles and linkage assemblies connecting the poles. Within the joints of the linkage assemblies are rolling element bearings to reduce joint friction and provide reinforcement support to the shelter frame.

15 Claims, 10 Drawing Sheets

U.S. PATENT DOCUMENTS 4,431,331 A 2/1984 Brody
4,465,392 A * 8/1984 Lang ..... 403/24
4,472,075 A 9/1984 Forni
4,548,125 A 10/1985 Hüther
4,607,656 A 8/1986 Carter
4,615,402 A 10/1986 Eisenloeffel
4,667,577 A 5/1987 Rösch
4,684,280 A 8/1987 Dirkin et al.
4,689,932 A 9/1987 Zeigler
4,766,980 A 8/1988 Engle
4,779,635 A 10/1988 Lynch
4,808,023 A 2/1989 Arnold et al.
4,844,109 A 7/1989 Navarro
4,846,204 A 7/1989 Sok Kyu
4,872,361 A 10/1989 Muller
4,885,891 A 12/1989 Lynch
4,924,896 A 5/1990 Carter
4,929,113 A 5/1990 Sheu
4,947,884 A 8/1990 Lynch
5,035,253 A 7/1991 Bortles
5,244,001 A 9/1993 Lynch
5,274,980 A 1/1994 Zeigler
5,275,188 A 1/1994 Tsai
5,351,701 A 10/1994 Hsiao
5,361,794 A 11/1994 Brady
5,387,048 A 2/1995 Kuo
5,421,356 A 6/1995 Lynch
5,423,341 A 6/1995 Brady
5,444,946 A 8/1995 Zeigler
5,485,863 A 1/1996 Carter
5,490,532 A 2/1996 Mallookis et al.
5,490,533 A 2/1996 Carter
5,511,572 A 4/1996 Carter
5,632,293 A * 5/1997 Carter ..... 135/145
5,638,853 A 6/1997 Tsai
6,035,877 A * 3/2000 Losi et al. ..... 135/131
6,076,770 A * 6/2000 Nygren et al. ..... 244/158 R
6,095,319 A * 8/2000 Noniewicz et al. ..... 198/632
6,206,020 B1 * 3/2001 Lynch ..... 135/128
6,382,224 B1 * 5/2002 Carter ..... 135/145
6,470,902 B1 * 10/2002 Carter ..... 135/145

FOREIGN PATENT DOCUMENTS

EP 1186733 * 9/2001
GB 198803 6/1923
GB 672815 5/1952

* cited by examiner

PORTABLE SHELTER WITH ROLLING ELEMENT BEARINGS

CROSS REFERENCE TO RELATED APPLICATIONS

This application claims the benefit of U.S. Provisional Application 60/482,503, entitled Portable Shelter Framework, filed Jun. 24, 2003, and U.S. Provisional Application 60/449,124 entitled Shade Structure With Roller Bearings, filed Feb. 21, 2003, both of the contents of which are hereby incorporated by reference.

BACKGROUND OF THE INVENTION

1. Field of Invention

The present invention relates generally to shelters and, more particularly, to shelters including collapsible frames.

2. Description of the Related Art

Over the years, a seemingly endless variety of tents and other shelters having collapsible frames have been introduced into the market. Such structures are commonly used to provide shelter during camping trips, picnics, parties, military operations and other outdoor activities. Because their frames are collapsible, relatively large shelters may be folded into a compact configuration for storage and transport.

The inventors herein have discovered that there are a number of shortcomings associated with the collapsible shelters that have been introduced heretofore. More specifically, the inventors herein have discovered that the frames associated with prior collapsible shelters tend to be difficult to fold and unfold, unstable, and somewhat large when folded. Some prior shelter frames also allow the canopy to sag and form unsightly pockets where water can accumulate, reduce tent headroom and/or ultimately produce an unsightly shelter.

For example, a prior open-type collapsible tent is shown in FIGS. 7 and 8. The tent consists of a frame which supports a canopy D. The frame includes four poles A, each of which is secured to a center strut C by a scissors-type linkage B. The scissors-type cross joints B are secured to the poles A by fixed hinges A1 at the top of each pole and sliding hinges A2 which slide along the poles as the frame is moved between the folded and unfolded orientations. The other ends of the cross joints B are secured to the center strut C by a fixed cross-shaped connector F and a sliding connector E which slides along the center strut as the frame is moved between the folded and unfolded orientations.

The shelter frame shown in FIGS. 7 and 8 is somewhat unstable because the legs A are not directly connected to one another and, instead, are only connected to one another by the structure formed by the scissors-type cross joints B, the center strut C and the connectors E and F. In addition to being unstable, the scissors-type linkage/center strut/connector structure also reduces the headroom within the tent. This frame is also somewhat difficult to unfold in that an extra person is sometimes needed to push the center strut C upwardly to its completely extended position. With respect to the canopy D, the center strut C is the only portion of the frame that holds the canopy above the poles and, as a result, the canopy will often sag.

Another example of a conventional shelter frame is shown in U.S. Pat. No. 4,607,656 ("the '656 patent") the contents of which are hereby incorporated by reference. The frame disclosed in the '656 patent is a marginal improvement over the frame illustrated in FIGS. 7 and 8 in that stability is increased because adjacent support poles are connected to one another by respective pairs of scissors-type cross joints. Nevertheless, the shelter frame disclosed in the '656 patent suffers from many of the same shortcomings as the frame shown in FIGS. 7 and 8. For example, the canopy is supported by a single central support and, therefore, tends to sag. The central support post is itself supported by a pair of scissors-type cross joints which extend across the interior of the shelter. This configuration reduces headroom within the shelter. Moreover, the lowest portion of each of the scissors-type linkage pairs is half way between the poles, thereby reducing headroom in the area that often serves as the entrance to a tent.

Another example of a shelter frame is shown in U.S. Pat. No. 6,035,877 ("the '877 patent") the contents of which are hereby incorporated by reference. The frame of the '877 patent represents an improvement over previous designs by providing a modified canopy frame design that eliminates a central support member, providing additional usable room beneath the portable shelter.

Despite these improvements, shelter frame designs remain difficult to expand and contract, especially for a single user. Nearly all previous shelter frame joints use a single bolt to fasten multiple members together while attempting to allow for rotational movement relative to each other. This arrangement creates friction between members which in turn makes expansion or contraction of the joint more difficult. Consequently, portable shelter manufacturers are caught between two equally undesirable alternatives: tighten the bolts of these joints very tightly or leave the bolts relatively loose. If the joint bolts are significantly tightened, the shelter frame will be more structurally secure at the cost of considerable increased friction. On the other hand, leaving the bolts relatively loose reduces the above mentioned joint friction but increases the "play" in the joints, greatly reducing shelter frame structural integrity, increasing joint wear, and decreasing the lifespan of the shelter.

What is needed is an improved shelter frame design that provides maximum usable room within the shelter, structural integrity, and minimal force to expand or contract.

OBJECTS AND SUMMARY OF THE INVENTION

A general object of the present invention is to provide a collapsible shelter that is superior to those presently known in the art. In particular, one object of the present invention is to provide a shelter frame that is relatively easy to fold and unfold, stable, and still compact when folded. Another object of the present invention is to provide a shelter frame that is less likely to allow the canopy to sag, will not reduce tent headroom and will ultimately produce an attractive shelter. A further object of the present invention is to provide an easily expanded shelter frame. Yet a further object of the present invention is to provide a shelter frame that can be expanded by a single person.

In accordance with one aspect of the present invention, these and other objectives are accomplished by providing a shelter frame having at least two poles connected by a linking assembly having first and second scissors-type cross joints and a linking device. The scissors-type cross joints include first structural members pivotally coupled to respective second structural members, having a rolling element bearing positioned between both member. The linking device is adapted to pivotally secure a predetermined portion of the second structural member in the first scissors-type linkage to the second scissors-type linkage at a point on the second scissors-type linkage vertically spaced from the predetermined portion of the second structural member in the first scissors-type linkage and to also pivotally secure a predetermined portion of the second structural member in the second scissors-type linkage to the first scissors-type linkage at a point on the first scissors-type linkage vertically spaced from the predetermined portion of the second structural member in the second scissors-type linkage.

In accordance with another aspect of the present invention, other objectives are accomplished by providing a shelter frame with a canopy support including a head connector and at least first and second canopy support rods. Each canopy support rod includes a first rod member pivotally secured to a second rod member by way of a rolling element bearing joint. The first rod members are also pivotally secured to a respective pole and the second rod members are also pivotally secured to the head connector. As a result, the canopy support provides a greater support area than many prior canopy supports, which results in an aesthetically pleasing shelter canopy that is less likely to sag. The shelter frame may also include linking rods that are pivotally secured to sliding connectors on the poles and to the canopy support rods. The linking rods help drive the canopy support to its unfolded orientation as the frame poles are pulled apart. As a result, the canopy support need not be manually pushed to its unfolded orientation.

In accordance with still another aspect of the present invention, each joint of the portable shelter contains a rolling element bearing to allow joint movement with less applied force. In this respect, the shelter frame may be expanded or contracted with less effort from the user.

Many other features and attendant advantages of the present invention will become apparent as the invention becomes better understood by reference to the following detailed description considered in conjunction with the accompanying drawings.

DETAILED DESCRIPTION OF THE INVENTION

The following is a detailed description of the best presently known mode of carrying out the invention. This description is not to be taken in a limiting sense, but is made merely for the purpose of illustrating the general principles of the invention. The scope of the invention is defined solely by the appended claims.

Figure 1:
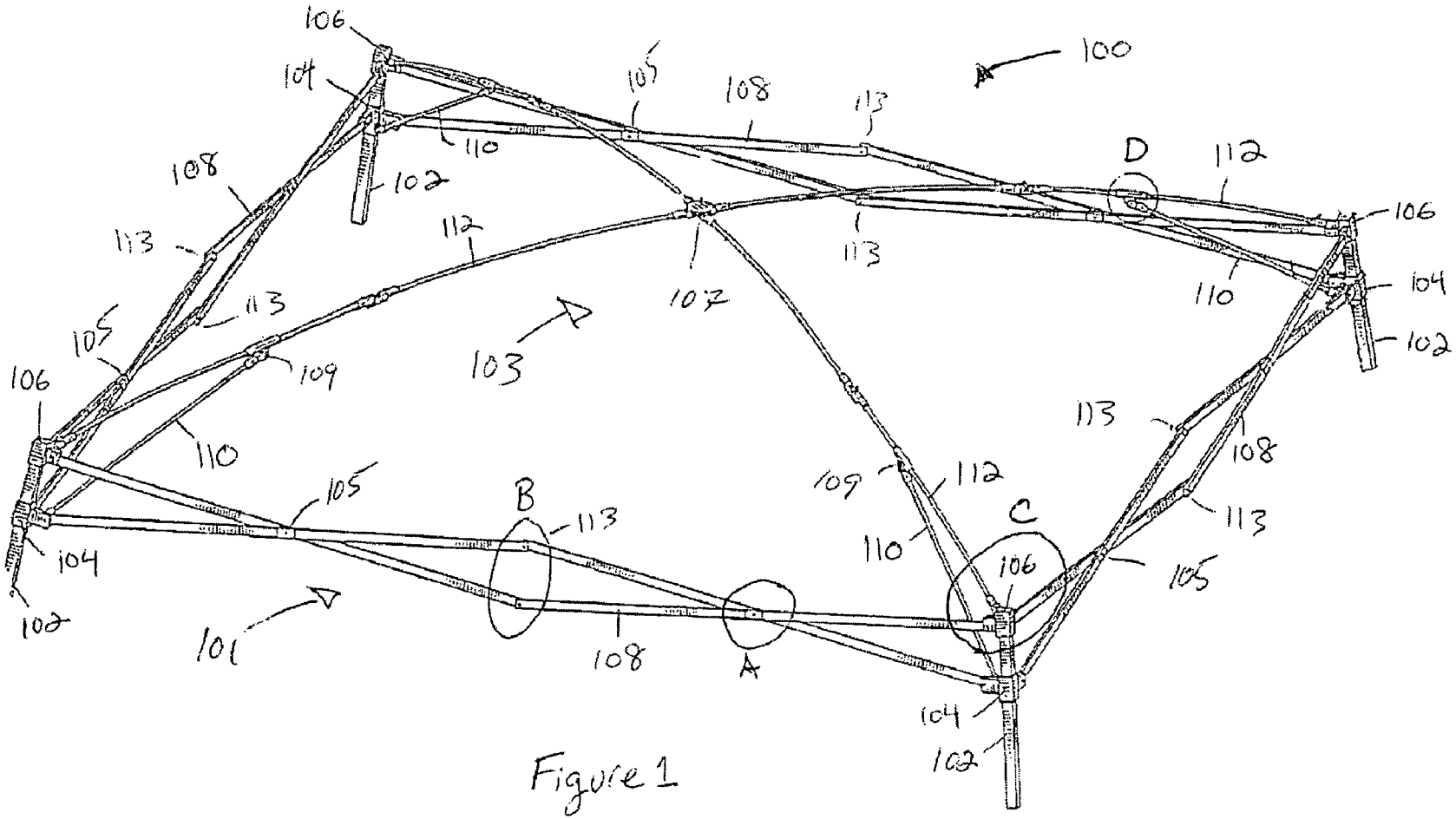
FIG. 1 is a perspective view of a collapsible shelter frame in accordance with a preferred embodiment of the present invention.

As shown by way of example in FIG. 1, a shelter frame 100 in accordance with a first preferred embodiment of the present invention includes a lower frame member 101 and a canopy support 103. The lower frame member 101 includes four upwardly extending poles 102 that are connected to one another by four pairs of scissors-type (or x-type) cross joints 105. Each of the scissor-type cross joints 105 are pivotally secured to another linkage and to one of the poles 102. The cross joints 105 are secured to the poles 102 by fixed connectors 106, which are secured to the top of each pole, and sliding connectors 104 which slide along the poles. The exemplary canopy has supporting rods 112, each of which is pivotally secured to a head 107. The canopy supporting rods 112 are also pivotally secured to respective linking rods 110 and fixed connectors 106. The linking rods 110 are pivotally secured to respective sliding connectors 109.

Figure 2:
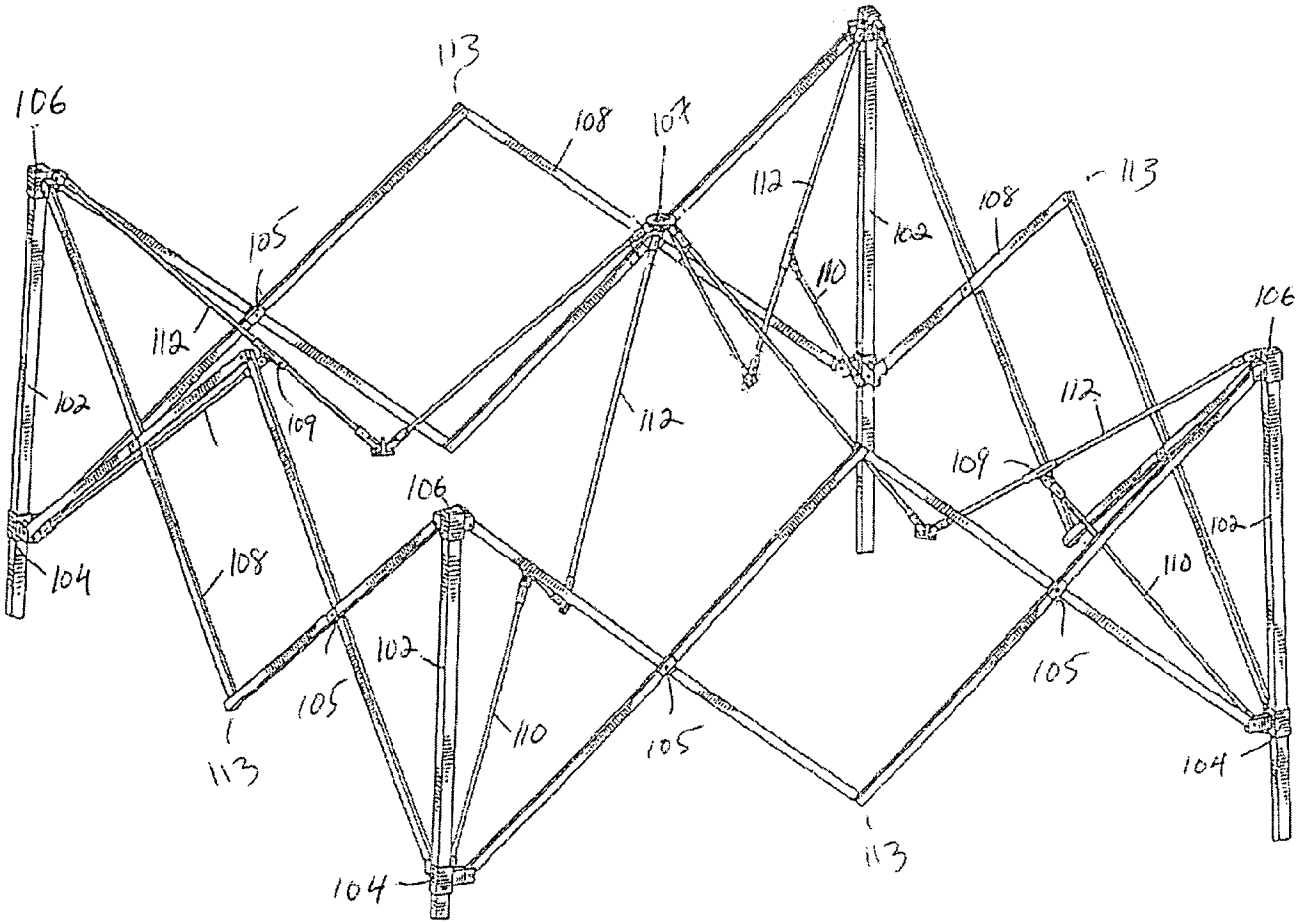
FIG. 2 a perspective view of the preferred embodiment shown in FIG. 1 in a partially folded orientation.
Figure 5:
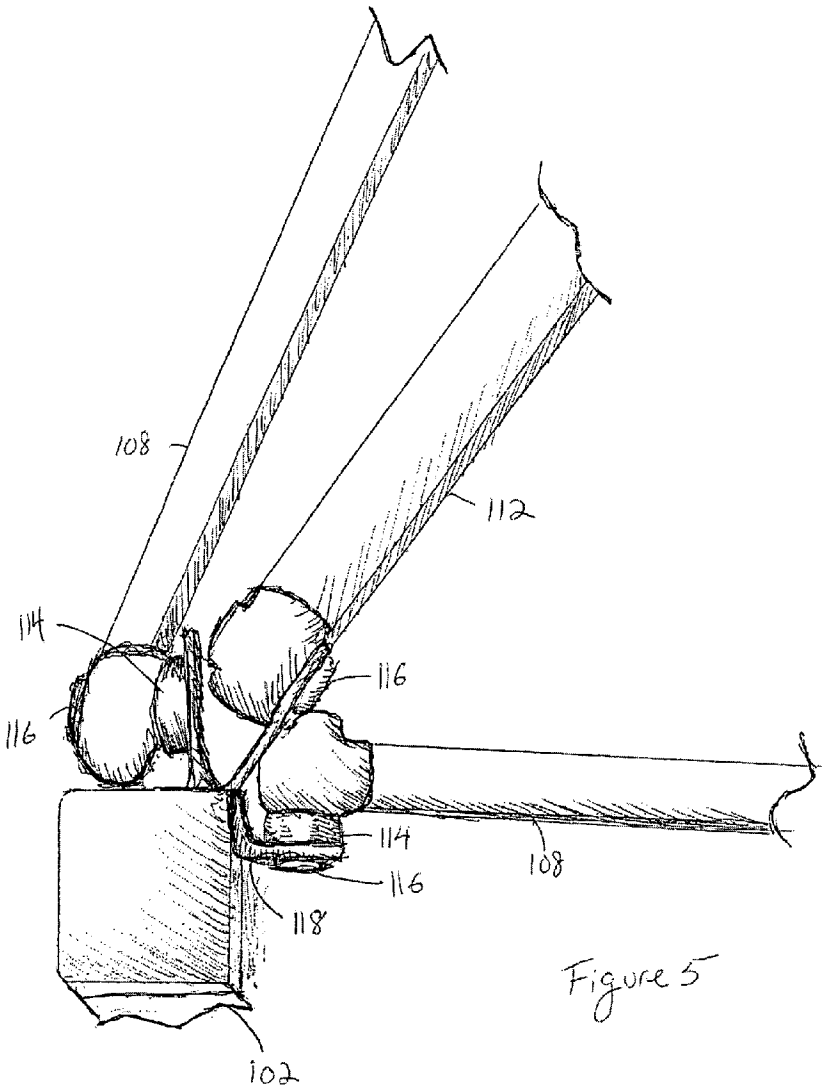
FIG. 5 is an enlarged top view of the portion of the preferred embodiment identified by circle C in FIG. 1.

The fixed connectors 106 act to pivotally mount two side rails 108 and a canopy support rod 112, as best seen in FIGS. 1, 2, and 5. The fixed connector bracket 118 secures to the top of pole 102 while providing three pivotal mounting areas off the pole 102. Each of the side rails are preferably mounted in the same arrangement by a securing bolt 116 passing through an aperture in the end of side rail 108, rolling element bearing 116, and fixed connector bracket 118. In this fashion, the rolling element bearing 114 is positioned between the side rail 108 and the fixed connector bracket 118, allowing each joint to pivot with reduced friction.

The canopy support rod 112 is shown in FIG. 5 as being secured to pole 102 in a similar fashion to side rails 108, except for a lack of a rolling element bearing 114. Optionally, this joint may include a rolling element bearing 114 to reduce friction during movement.

The poles 102 may include a locking assembly which locks the sliding connector 109 in place when it reaches the location shown in FIG. 1. Preferably, each locking assembly may consist of a button that is forced through an aperture in the pole 102 by a spring to which the button is attached. In operation, the button is depressed as the sliding connector 104 moves from the unlocked position shown in FIG. 2 to the locked position shown in FIG. 1. Such depression may be accomplished manually, or by means of a cam surface on the bottom side of the button. Once the button is depressed, the sliding connector 104 will pass over the button until a corresponding aperture on the sliding connector 104 is aligned with the button. The button will then be forced by the spring through the sliding connector 104 aperture, thereby locking the sliding connector 104 in place. The button may be depressed to release the sliding member 104 when the user desires to fold the frame 100.

Turning to the canopy support 103 shown in FIGS. 1 and 2, each canopy support rod 112 consists of two rod members pivotally connected to one another by an intermediate pivot connector. The intermediate pivot connector includes a pair of stop boards which prevent the rods 112 from pivoting past the unfolded orientation shown in FIG. 1.

As noted above, one end of each canopy support rod 112 is secured to a fixed linkage 106 and the other end is secured to the head 107. The preferred head 107 includes four head connectors, each of which consists of a pair of parallel walls that mate with the three parallel walls on the rod member 112 ends. The connectors are secured to the rod member 112 ends by a nut and bolt.

Figure 6:
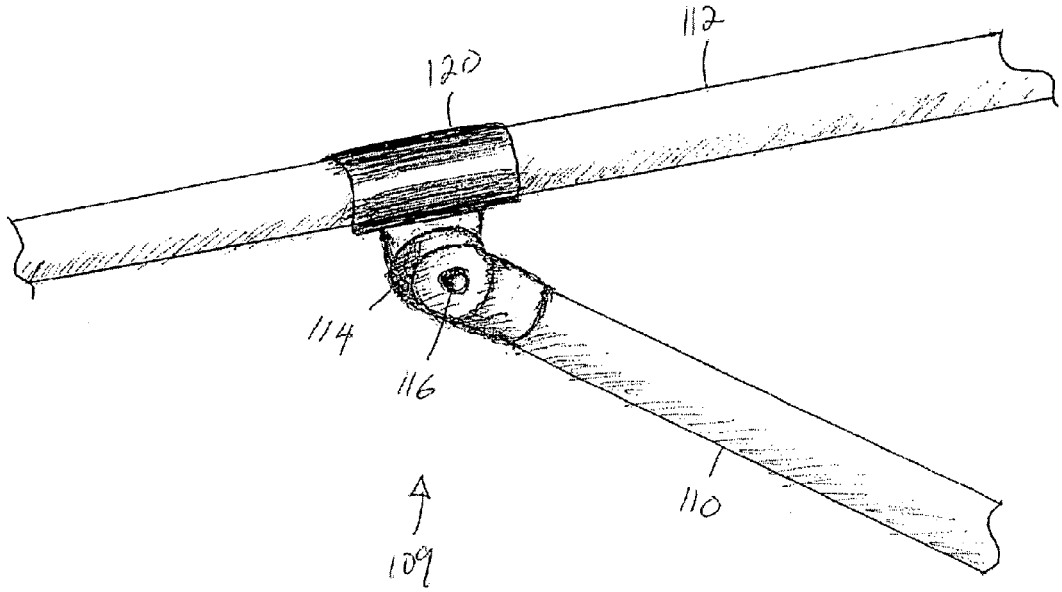
FIG. 6 is an enlarged view of the portion of the preferred embodiment identified by circle D in FIG. 1.
Figure 7:
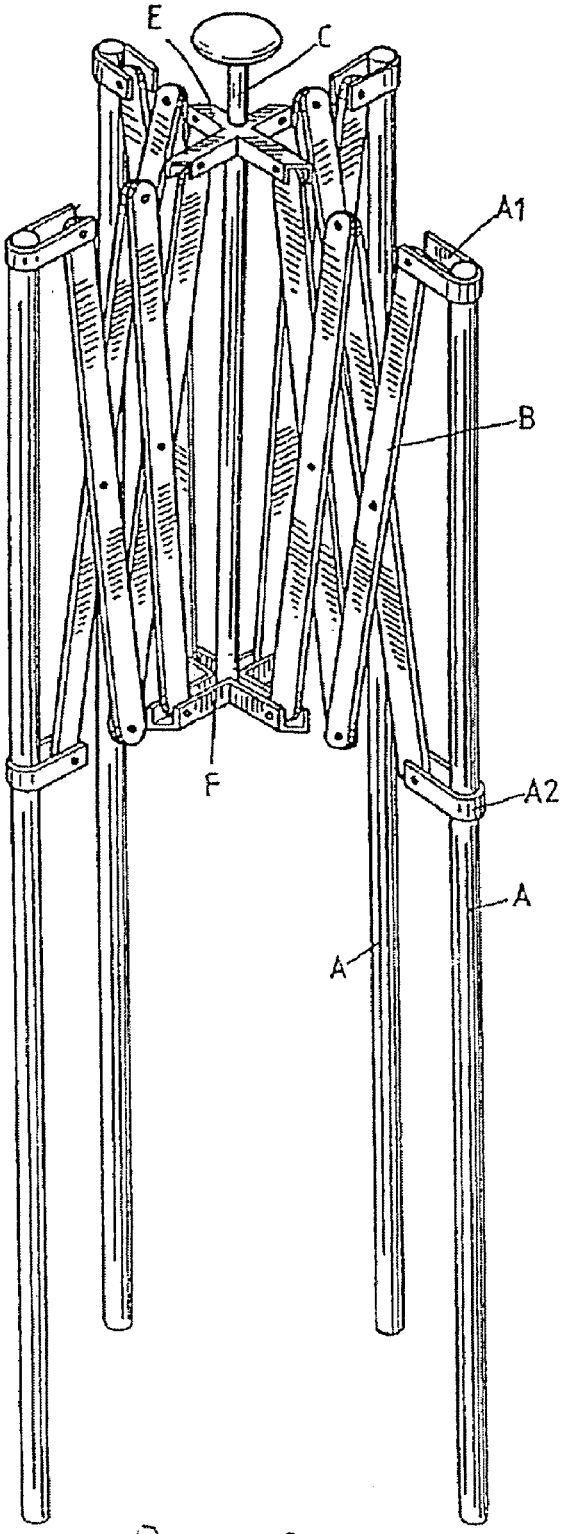
figure 7 (PRIOR ART)
FIG. 7 is a perspective view of a prior collapsible shelter frame in a folded orientation.
Figure 8:
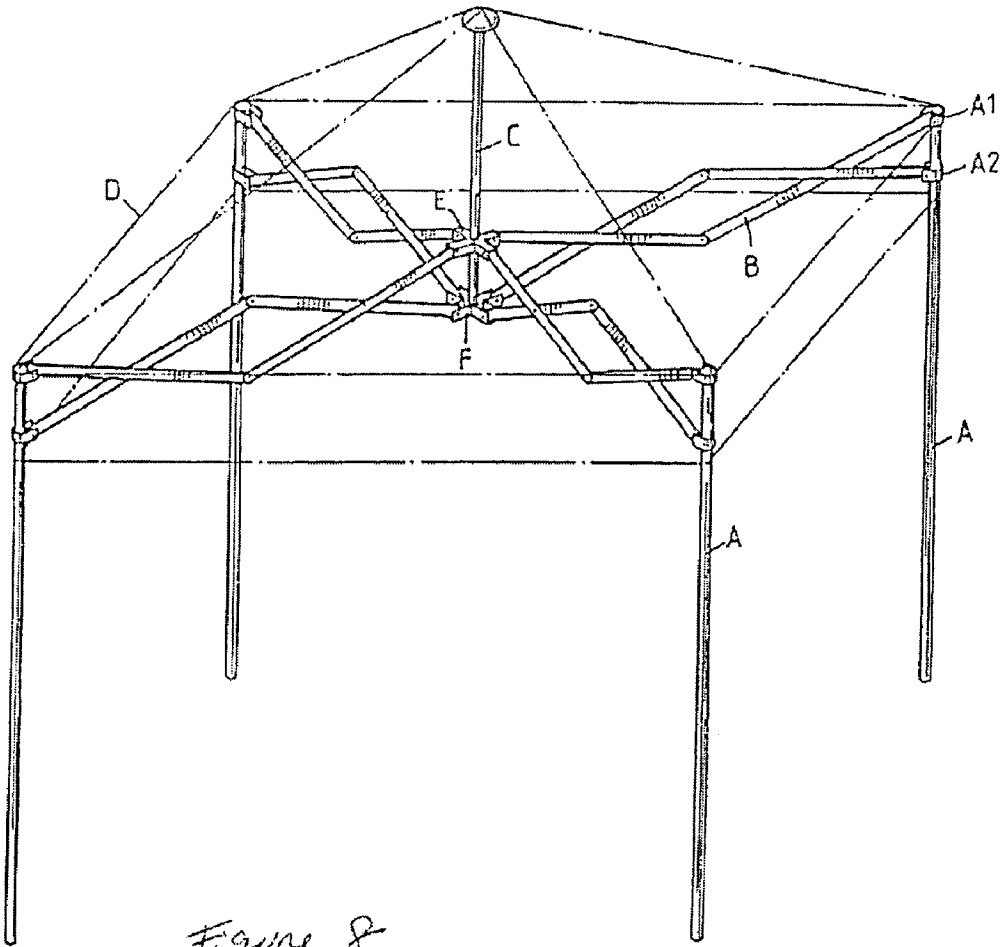
Figure 8 (PRIOR ART)
FIG. 8 is a perspective view of the prior collapsible shelter frame of FIG. 7 in an expanded orientation.

As illustrated in FIGS. 1, 2, and 6, one end of each linking rod 110 is pivotally and slidably connected to the corresponding canopy support rod 112 by a sliding connector 109. Best seen in FIG. 6, sliding connector 109 is made up of sliding member 120, rolling element bearing 114 and securing bolt 116. Within the end of linking rod 110 is an aperture of similar size to an aperture in sliding member 120. The securing bolt 116 passes through the apertures in both sliding member 120 and linking rod 110, as well as the rolling element bearing 114. In this manner, the rolling element bearing is situated between the linking rod 110 and the sliding member 120, reducing frictional movement about the sliding connector 109. Thus, as the linking rod 110 slides against the canopy support rod 112, the linking rod 110 may pivot and change angles to accommodate its change in position.

Figure 3:
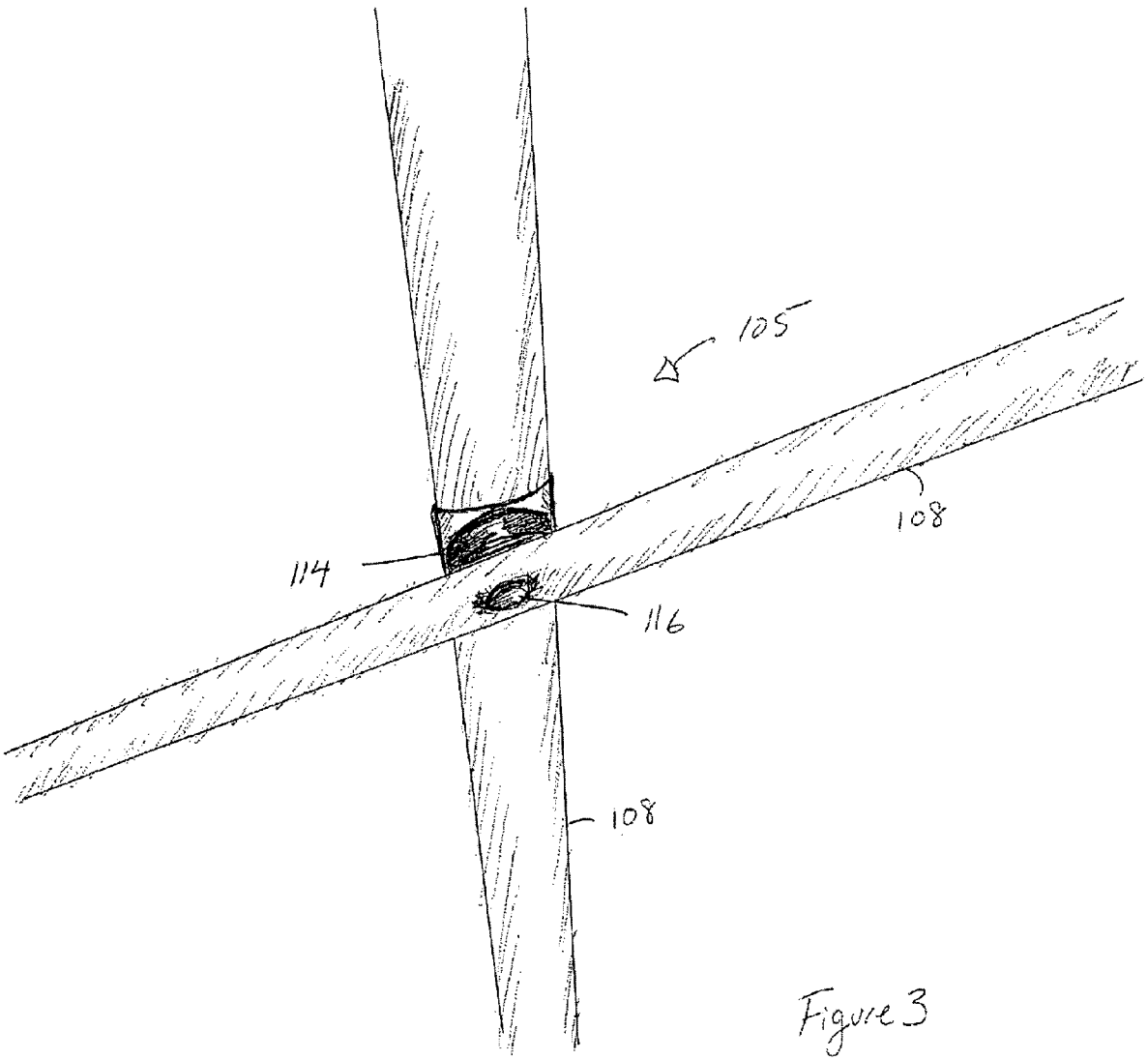
FIG. 3 is an enlarged view of the portion of the preferred embodiment identified by circle A in FIG. 1.

Best seen in FIGS. 1–4, side rails 108 form scissor-type joints by way of two different joint types: cross joints 105 and rail end joints 113. The cross joints 105, best seen in FIG. 3, are formed by crossing side rails 108 at their centers, where apertures sized to accept securing bolt 116 are located. The joint 105 is created by aligning the side rail 108 apertures, placing a rolling element bearing 116 between the side rail 108 apertures, then securing these components together with securing bolt 116. As with previously described joints, the rolling element bearing 114 provides reduced friction movement between the side rails 108, requiring reduced force to contract or expand the cross joint 105.

Figure 4:
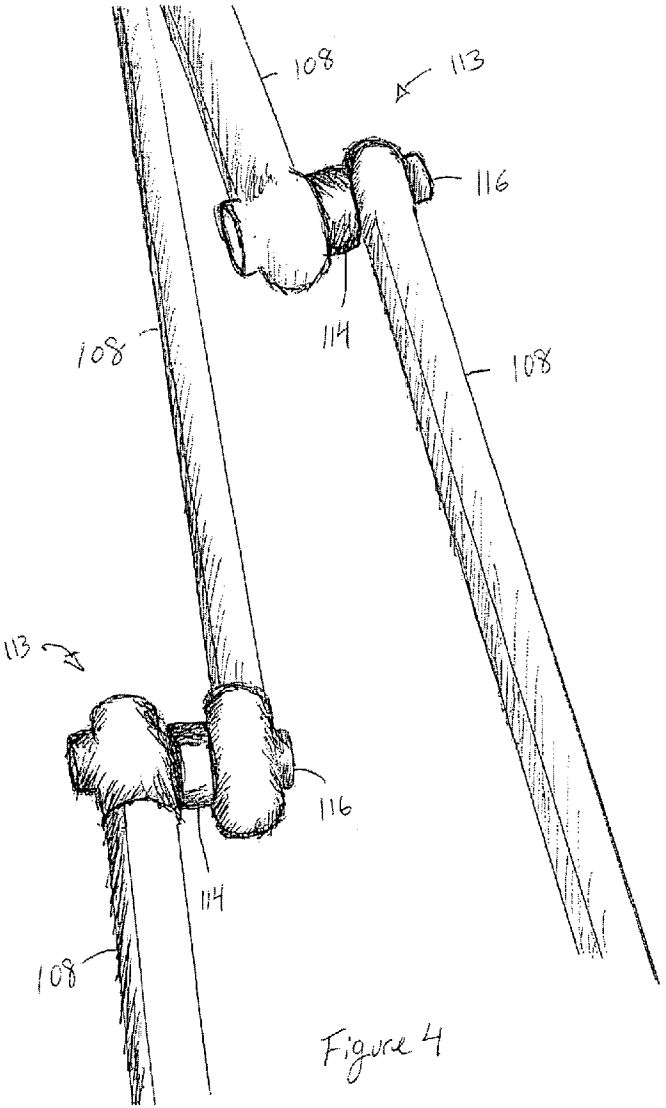
FIG. 4 is an enlarged view of the portion of the preferred embodiment identified by circle B in FIG. 1.

The rail end joints 113 function similarly to the previously described cross joints 105, but instead are located at the end of side rails 108, as best seen in FIG. 4. As with cross joints 105, the rail end joints 113 have a rolling element bearing 114 positioned between two side rail 108 ends and are held together by a securing bolt 116 that passes through apertures in the side rails 108 and rolling element bearings 114. In this manner, the rolling element bearing 114 reduces the friction between the side rails 108 as the rail end joints 133 flex.

As seen in the preferred embodiment of FIGS. 2–6, rolling element bearings 114 are included within the various joints of shelter frame 100. Preferably, such rolling element bearings are at least included between the side rails 108 of the shelter frame to provide significant reduction in joint friction. Although any rolling element bearing type may be used for rolling element bearing 114, roller bearings (see FIG. 11) and thrust bearings (see FIGS. 9 and 10) are preferred.

Typically, rolling element bearings with a contact angle of less than 45 degrees have a much greater radial load capacity and are classed as radial bearings, whereas bearings which have a contact angle of over 45 degrees have a greater axial load capacity and are classed as thrust bearings. When the loading characteristics of both radial and thrust bearings are combine, they are often classed as complex bearings.

Most rolling element bearings consist of rings with an inner ring and an outer ring (a raceway), rolling elements, and a cage (rolling element retainer). The retainer separates the rolling elements at regular intervals and holds them in place within the inner and outer raceways, allowing them to rotate freely.

The above mentioned rolling elements are generally ball-shaped or roller shaped. The rollers are found in a few typical styles, including cylindrical, tapered, needle and spherical. Other classification methods include the number of rolling rows (single, multiple, or 4 row), separable and non-separable (inner or outer ring can be detached), and thrust bearing that carry axial load in one or two directions. Balls geometrically contact the raceway surfaces of the inner and outer rings at points, while the roller's surface provides a line of contact.

Generally, ball bearings exhibit a lower frictional resistance and lower face run-out in rotation than roller bearings. This makes them more suitable for use in applications which require high speed, high precision, low torque and low vibration. Roller bearings, however, have a larger load applications requiring long life and endurance for heavy loads and shock loads. A cut-away view of a typical roller bearing can be seen in FIG. 11.

Figure 9:
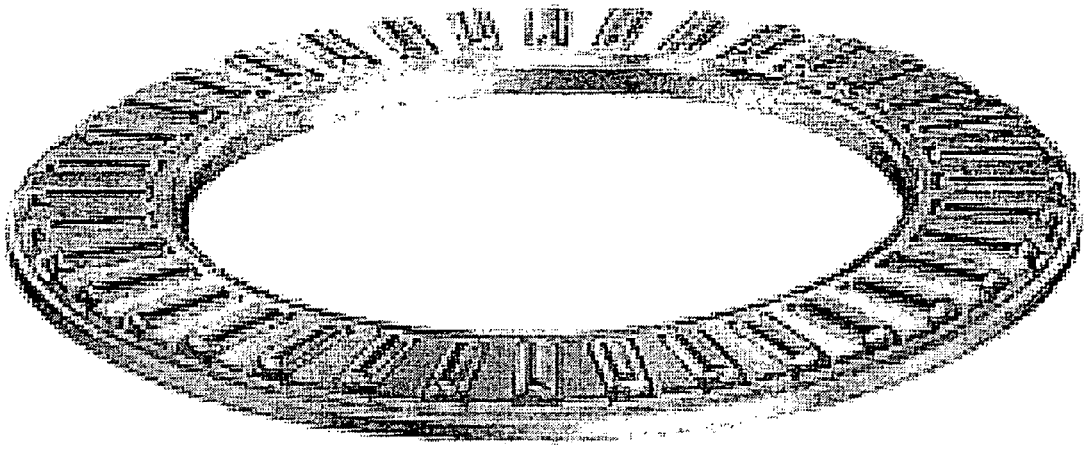
FIG. 9 is a perspective view of a roller element thrust bearing according to the present invention.
Figure 10:
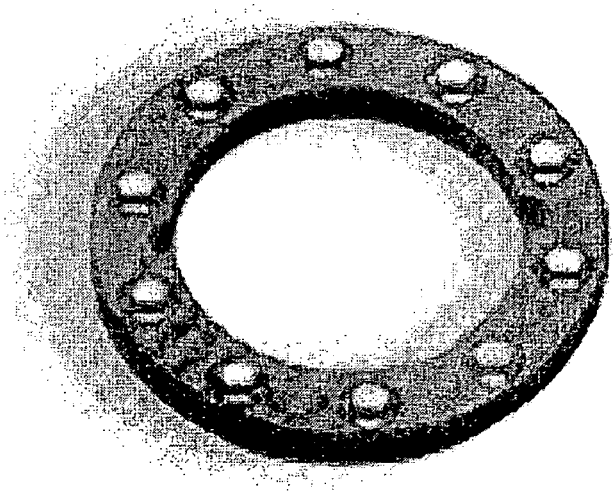
FIG. 10 is a perspective view of a roller element ball thrust bearing according to the present invention.
Figure 11:
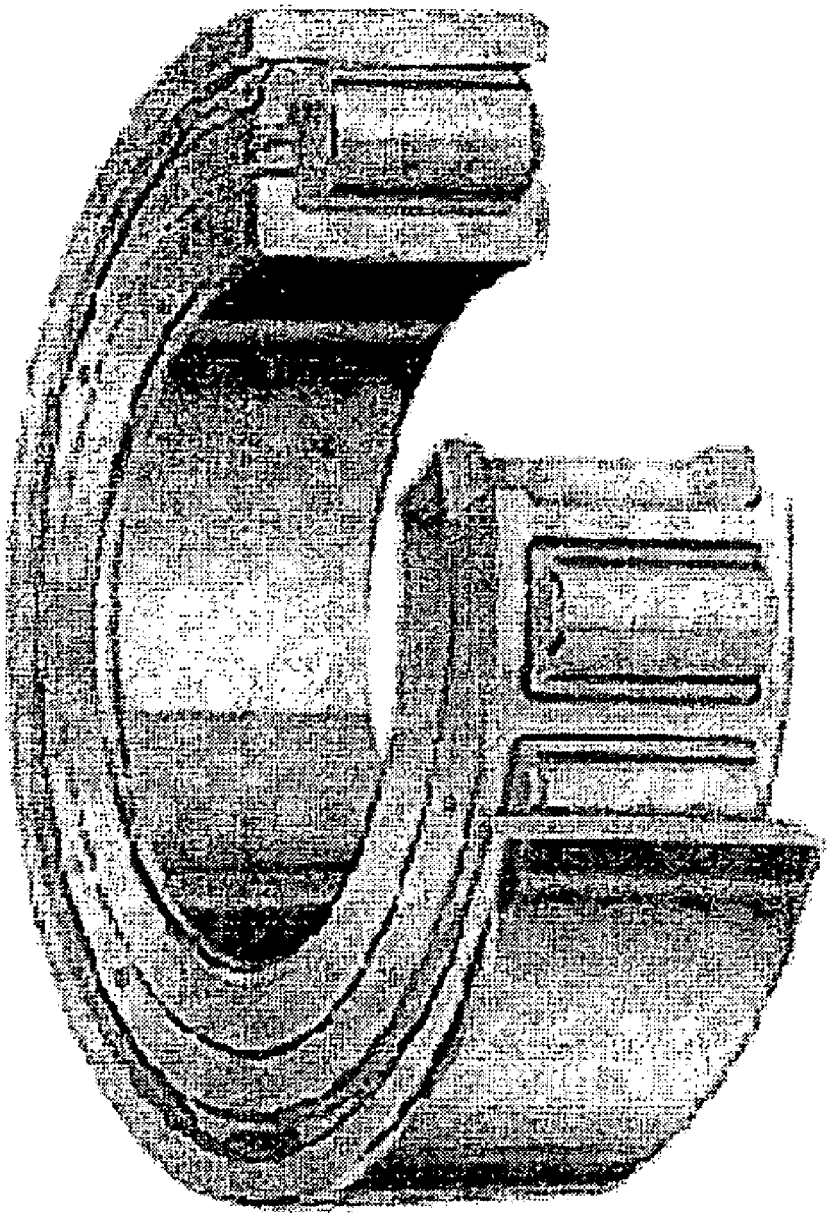
FIG. 11 is a perspective view of a rolling element bearing according to the present invention.

Thrust bearings are designed for pure thrust loads, and can handle little or no radial load. The rolling elements in a thrust bearing can be a ball, needle or roller, depending on its use. FIG. 9 illustrates an exemplary roller thrust bearing while FIG. 10 illustrates an exemplary ball thrust bearing.

Since the joints of shelter frame 100 will typically encounter some axial loading during use, it is preferable that the rolling element bearings 114 support at least some axial load. In this respect, roller bearings and thrust bearings provide the most benefit in regards to their above mentioned characteristics. However, it should be understood that other rolling element bearings may be used with the present invention to provide improved functionality over the prior art, so long as the rolling element bearing is capable of rotating and of supporting the loads associated with the joints of shelter frame 100.

In addition to the benefits of friction reduction, these rolling element bearings act to reinforce the bolt holes in the cross bars, increasing the overall strength of the shelter frame 100. Such reinforcement also serves to increase the product lifespan and overall durability of the shelter frame 100, providing superior performance when compared to prior art designs.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A shelter frame, comprising:

at least first and second upwardly extending poles;

a linkage assembly linking the first and second poles, said linkage assembly having joints;

at least first and second fixed connectors pivotally securing first portions of said linkage assembly to said first and second poles respectively;

at least first and second sliding connectors pivotally securing second portions of said linkage assembly to said first and second poles respectively;

a connector locking assembly sized and shaped to lock said first sliding connector relative to said first fixed connector; and a rolling element bearing interposed between mating members of said linkage assembly, wherein when said linkage assembly is folded and unfolded said mating members are operable to rotate about said rolling element bearing and cause movement of said rolling element bearing relative to said first fixed connector and said first sliding connector, and wherein said rolling element bearing moves in a plane that is substantially parallel to a plane that is defined by connection points of said first fixed connector, first sliding connector, and second fixed connector to said first and second poles respectively.

2. The shelter frame of claim 1 wherein said rolling element bearing is a roller bearing.

3. The shelter frame of claim 1 wherein said rolling element bearing is a thrust bearing.

4. The shelter frame of claim 1 further including at least a third and fourth upwardly extending poles linked by said linkage assembly.

5. The shelter frame of claim 1 further including canopy supports secured to said first and second poles.

6. A portable frame for creating a shelter, comprising:

a first and second pole;

a jointed linking arm connected to said first and second pole, said jointed linking arm having rolling element bearings located within the joints of said linking arm, wherein when said linking arm is folded and unfolded said rolling element bearings move in a plane that is substantially parallel to a plane that is defined by the connection points of said jointed linking arm to said first and second poles; and a canopy support brace fixed to the top of said first and second poles.

7. The portable frame of claim 6 wherein said rolling element bearings are roller bearings.

8. The portable frame of claim 6 wherein said rolling element bearings are thrust bearings.

9. The portable frame of claim 6 further including a slideable locking connector and a fixed connector shaped and positioned to secure said jointed linking arm with said first and second poles.

10. The portable frame of claim 6 further comprising:

third and fourth upwardly extending poles;

a second jointed linking arm connected to said second and third poles;

a third jointed linking arm connected to said third and fourth poles; and a fourth jointed linking arm connected to said first and fourth poles.

11. The portable frame of claim 6 wherein said canopy support brace includes a head connector and at least first and second canopy support rods, each support rod including a first rod member pivotally secured to a second rod member, said first rod members also pivotally secured to a respective pole and said second rod members also pivotally secured to said head connector.

12. A portable shelter comprising:

a plurality of support legs;

a plurality of trusses connecting said support legs together;

said trusses comprised of a plurality of truss members interconnected to each other so as to create a truss that is selectively expandable and retractable;

a plurality of joints connecting said truss members together; and a rolling element bearing being disposed in at least one of said plurality of joints of said truss members, said truss members operable to rotate about said rolling element bearing when said truss is expanded and retracted causing movement of the roller element bearing relative to said support legs, wherein said rolling element bearing moves in a plane that is substantially parallel to a plane that is defined by connection points of the truss associated with the rolling element bearing and the support legs that the truss connects.

13. A portable shelter according to claim 12 comprising:

a plurality of attachment points between said trusses and support legs; and a rolling element bearing being disposed in at least one of said attachment points.

14. A portable shelter according to claim 12, further comprising:

a canopy support framework interconnected with said plurality of support legs;

a plurality of mounting locations wherein said canopy support framework interconnects with said support legs; and a rolling element bearing being dispersed in at least one of said mounting locations.

15. A portable shelter according to claim 12, further comprising:

a canopy support framework interconnected with said plurality of support legs;

said canopy support framework including a plurality of interconnected canopy support members; and a rolling element bearing disposed in at least one of a joint of said interconnected canopy support members.

* * * * *